US008629095B2

(12) United States Patent
Deleersnyder et al.

(10) Patent No.: US 8,629,095 B2
(45) Date of Patent: Jan. 14, 2014

(54) LIQUID CLEANING AND/OR CLEANSING COMPOSITION COMPRISING POLYURETHANE FOAM ABRASIVE PARTICLES

(75) Inventors: Geert Andre Deleersnyder, Wielsbeke (BE); Denis Alfred Gonzales, Brussels (BE); Martin Ian James, Cincinnati, OH (US); Eva Maria Perez-Prat Vinuesa, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/090,411

(22) Filed: Apr. 20, 2011

(65) Prior Publication Data

US 2011/0262371 A1 Oct. 27, 2011

Related U.S. Application Data

(60) Provisional application No. 61/326,290, filed on Apr. 21, 2010, provisional application No. 61/424,852, filed on Dec. 20, 2010.

(51) Int. Cl.
*C11D 3/14* (2006.01)
*C11D 3/37* (2006.01)

(52) U.S. Cl.
USPC ..... 510/395; 510/130; 510/139; 510/235; 510/236; 510/268; 510/368

(58) Field of Classification Search
USPC ..... 510/130, 139, 235, 236, 268, 368, 395
See application file for complete search history.

(56) References Cited

U.S. PATENT DOCUMENTS

| | | | |
|---|---|---|---|
| 1,621,906 | A | 3/1927 | Schloss |
| 2,082,275 | A | 6/1937 | Daimler et al. |
| 2,084,632 | A | 6/1937 | Ellis |
| 2,255,082 | A | 9/1941 | Orthner et al. |
| 2,438,091 | A | 3/1948 | Lynch |
| 2,528,378 | A | 10/1950 | Mannheimer |
| 2,658,072 | A | 11/1953 | Kosmin |
| 2,702,279 | A | 2/1955 | Funderburk et al. |
| 3,070,510 | A | 12/1962 | Cooley et al. |
| 3,586,715 | A | 6/1971 | Smeets |
| 3,812,044 | A | 5/1974 | Connor et al. |
| 3,915,903 | A | 10/1975 | Wise |
| 3,929,678 | A | 12/1975 | Laughlin et al. |
| 3,985,668 | A | 10/1976 | Hartman |
| 4,025,444 | A | 5/1977 | Murphy et al. |
| 4,051,056 | A | 9/1977 | Hartman |
| 4,088,620 | A | 5/1978 | Nihongi et al. |
| 4,102,992 | A | 7/1978 | Davis |
| 4,240,919 | A | 12/1980 | Chapman |
| 4,298,490 | A | 11/1981 | Lange et al. |
| 4,309,316 | A | 1/1982 | Lange et al. |
| 4,473,611 | A | 9/1984 | Haq |
| 4,481,126 | A | 11/1984 | Trinh et al. |
| 4,537,604 | A | 8/1985 | Dawson |
| 4,565,644 | A | 1/1986 | Smith et al. |
| 4,565,647 | A | 1/1986 | Llenado |
| 4,581,385 | A | 4/1986 | Smith et al. |
| 4,657,692 | A | 4/1987 | Choy et al. |
| 4,663,069 | A | 5/1987 | Llenado |
| 4,676,920 | A | 6/1987 | Culshaw |
| 4,704,233 | A | 11/1987 | Hartman et al. |
| 4,767,563 | A | 8/1988 | De Buzzaccarini |
| 2,184,454 | A | 9/1988 | Chirash et al. |
| 4,842,763 | A | 6/1989 | Troger et al. |
| 4,906,396 | A | 3/1990 | Falholt et al. |
| 5,287,207 | A | 2/1994 | Mulkens et al. |
| 5,500,451 | A | 3/1996 | Goldman et al. |
| 5,776,872 | A | 7/1998 | Giret et al. |
| 5,776,878 | A | 7/1998 | Theon |
| 5,798,505 | A | 8/1998 | Lee |
| 5,821,214 | A | 10/1998 | Weibel |
| 5,830,445 | A | 11/1998 | Bouillon et al. |
| 5,883,062 | A | 3/1999 | Addison et al. |
| 5,898,026 | A | 4/1999 | Yianakopoulos et al. |
| 5,906,973 | A | 5/1999 | Ouzounis et al. |
| 6,008,181 | A | 12/1999 | Cripe et al. |
| 6,020,303 | A | 2/2000 | Cripe et al. |
| 6,060,443 | A | 5/2000 | Cripe et al. |
| 6,080,707 | A | 6/2000 | Glenn et al. |
| 6,132,212 | A | 10/2000 | Horiguchi et al. |
| 6,221,829 | B1 | 4/2001 | Symes et al. |
| 6,242,405 | B1 | 6/2001 | Lykke et al. |
| 2,305,434 | A1 | 7/2001 | Luciani et al. |
| 6,265,363 | B1 | 7/2001 | Viscovitz |
| 6,274,540 | B1 | 8/2001 | Scheibel et al. |
| 6,299,746 | B1 | 10/2001 | Conte et al. |
| 6,306,817 | B1 | 10/2001 | Kott et al. |
| 6,359,031 | B1 | 3/2002 | Lykke et al. |
| 6,369,121 | B1 | 4/2002 | Catalfamo et al. |
| 6,444,716 | B1 | 9/2002 | Hird et al. |
| 6,514,926 | B1 | 2/2003 | Kott et al. |
| 6,525,233 | B1 | 2/2003 | Connor et al. |
| 6,537,957 | B1 | 3/2003 | Cardola et al. |

(Continued)

FOREIGN PATENT DOCUMENTS

| | | |
|---|---|---|
| DE | 24 10 425 A1 | 10/1974 |
| DE | 10 2004 03877 | 8/2005 |

(Continued)

OTHER PUBLICATIONS

ASTM Designation: F1877-05 Jun. 10, 2009; Standard Practice for Characterization of Particles; 14 pages; chapter 11.3.6; Section 11.3.2.

(Continued)

*Primary Examiner* — Charles Boyer

(74) *Attorney, Agent, or Firm* — John T. Dipre; Steven W. Miller

(57) ABSTRACT

The present invention relates to a liquid, cleaning and/or cleansing composition comprising abrasive cleaning particles.

16 Claims, 1 Drawing Sheet

(56) References Cited

U.S. PATENT DOCUMENTS

| | | | | |
|---|---|---|---|---|
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,699,963 | B2 | 3/2004 | Noda et al. | |
| 6,749,066 | B2 | 6/2004 | Bergman | |
| 6,759,377 | B2 | 7/2004 | Hackenthal et al. | |
| 6,767,878 | B1 | 7/2004 | Paye et al. | |
| 6,808,759 | B1 | 10/2004 | Okumura et al. | |
| 6,858,216 | B2 | 2/2005 | Schulze zur Wiesche et al. | |
| 7,307,055 | B2 | 12/2007 | Cook et al. | |
| 7,393,820 | B2 | 7/2008 | Soldanski et al. | |
| 7,713,921 | B2 | 5/2010 | Boutique et al. | |
| 7,994,111 | B2 | 8/2011 | Caggioni et al. | |
| 2002/0137647 | A1* | 9/2002 | Hackenthal et al. | 510/180 |
| 2002/0166832 | A1 | 11/2002 | Silud et al. | |
| 2002/0173243 | A1 | 11/2002 | Costas et al. | |
| 2003/0176633 | A1 | 9/2003 | Noda et al. | |
| 2003/0215417 | A1 | 11/2003 | Uchiyama et al. | |
| 2004/0216388 | A1 | 11/2004 | Mathur et al. | |
| 2004/0266645 | A1 | 12/2004 | Albrecht et al. | |
| 2005/0065056 | A1* | 3/2005 | Cook et al. | 510/438 |
| 2005/0130873 | A1 | 6/2005 | Cheung et al. | |
| 2005/0170979 | A1 | 8/2005 | Massaro et al. | |
| 2005/0201965 | A1 | 9/2005 | Kuhlman et al. | |
| 2006/0011885 | A1 | 1/2006 | Christmas et al. | |
| 2006/0094635 | A1 | 5/2006 | Pereira | |
| 2006/0177488 | A1 | 8/2006 | Caruso et al. | |
| 2007/0006391 | A1 | 1/2007 | Ghosh et al. | |
| 2007/0010415 | A1 | 1/2007 | Kinscherf et al. | |
| 2007/0041927 | A1 | 2/2007 | Blaeser et al. | |
| 2007/0043147 | A1 | 2/2007 | Higgins et al. | |
| 2007/0135645 | A1 | 6/2007 | Ignatyev et al. | |
| 2007/0138671 | A1 | 6/2007 | Anastasiou et al. | |
| 2007/0167345 | A1 | 7/2007 | Soldanski et al. | |
| 2007/0191256 | A1 | 8/2007 | Fossum et al. | |
| 2007/0270730 | A1 | 11/2007 | Rische et al. | |
| 2008/0108714 | A1 | 5/2008 | Swazey et al. | |
| 2008/0139702 | A1 | 6/2008 | De Almeida et al. | |
| 2008/0149137 | A1 | 6/2008 | Steinbrenner et al. | |
| 2008/0248144 | A1 | 10/2008 | Guenter et al. | |
| 2009/0176935 | A1 | 7/2009 | Boeckh et al. | |
| 2009/0253816 | A1 | 10/2009 | Nascimento et al. | |
| 2009/0291306 | A1 | 11/2009 | Quadbeck-Seeger | |
| 2009/0325837 | A1 | 12/2009 | Mundschau et al. | |
| 2010/0081604 | A1 | 4/2010 | Barger et al. | |
| 2010/0081605 | A1 | 4/2010 | Barger et al. | |
| 2010/0081606 | A1 | 4/2010 | Barger et al. | |
| 2010/0197553 | A1 | 8/2010 | Barnabas et al. | |
| 2011/0021123 | A1* | 1/2011 | Kulp et al. | 451/548 |
| 2011/0021398 | A1 | 1/2011 | Allef et al. | |
| 2011/0039744 | A1 | 2/2011 | Heath et al. | |
| 2011/0150787 | A1 | 6/2011 | Gonzales et al. | |
| 2011/0150788 | A1 | 6/2011 | Gonzales et al. | |
| 2011/0150949 | A1 | 6/2011 | Gonzales et al. | |
| 2011/0150950 | A1 | 6/2011 | Gonzales et al. | |
| 2011/0150951 | A1 | 6/2011 | Gonzales et al. | |
| 2011/0178196 | A1 | 7/2011 | Steinke et al. | |
| 2011/0189414 | A1 | 8/2011 | Whitehouse | |
| 2011/0262504 | A1 | 10/2011 | Deleersnyder et al. | |
| 2011/0287105 | A1 | 11/2011 | Gittleman | |
| 2012/0029519 | A1 | 2/2012 | Sengun et al. | |
| 2012/0066851 | A1 | 3/2012 | Gonzales et al. | |
| 2012/0071378 | A1 | 3/2012 | Gonzales et al. | |
| 2012/0071379 | A1 | 3/2012 | Gonzales et al. | |
| 2012/0071380 | A1 | 3/2012 | Gonzales et al. | |
| 2012/0071383 | A1 | 3/2012 | Perez-Prat Vinuesa et al. | |
| 2012/0202730 | A1 | 8/2012 | Allef et al. | |
| 2012/0252927 | A1* | 10/2012 | Malboeuf et al. | 523/122 |

FOREIGN PATENT DOCUMENTS

| | | | |
|---|---|---|---|
| DE | 10 2005 02380 | | 11/2006 |
| EP | 1 136 063 | A2 | 9/2001 |
| EP | 1 460 125 | A1 | 9/2004 |
| EP | 0 957 156 | B1 | 4/2005 |
| GB | 2 001 099 | A | 1/1979 |
| GB | 2 126 999 | A | 4/1984 |
| GB | 2 145 729 | A | 4/1985 |
| JP | 59192526 | A | 10/1984 |
| JP | 10025239 | A | 1/1998 |
| JP | 2005 296822 | A | 10/2005 |
| JP | 2007 077311 | A | 3/2007 |
| JP | 2009 160717 | A | 7/2009 |
| WO | WO 91/14420 | A1 | 10/1991 |
| WO | WO 1999/005084 | A1 | 2/1999 |
| WO | WO 99/52500 | A1 | 10/1999 |
| WO | 01/30315 | * | 5/2001 |
| WO | WO 01/31110 | A1 | 5/2001 |
| WO | WO 02/38720 | A1 | 5/2002 |
| WO | WO 2004/071483 | A1 | 8/2004 |
| WO | WO 2008/109270 | A1 | 9/2008 |

OTHER PUBLICATIONS

International Standard; ISA 9276-6:2008(E) section 8.2; section 7; Representation of results of particle size analysis—Part 6: Descriptive and quantitative representation of particle shape and morphology.

"Vegetable Ivory", W.P. Armstrong, (http://waynesword.palomar.edu/pljan99.htm).

"Phytelephas", Wikipedia.org (http://en.wikipedia.org/wiki/Phytelephas).

International Search Report; International Application No. PCT/US2011/032813; date of mailing Sep. 8, 2011; 4 pages.

U.S. Appl. No. 13/517,837, filed Jun. 14, 2012, Gonzales, et al.

U.S. Appl. No. 13/517,728, filed Jun. 14, 2012, Gonzales, et al.

U.S. Appl. No. 13/526,592, filed Jun. 19, 2012, Gonzales, et al.

U.S. Appl. No. 13/526,596, filed Jun. 19, 2012, Gonzales, et al.

U.S. Appl. No. 13/517,746, filed Jun. 14, 2012, Gonzales, et al.

U.S. Appl. No. 13/526,605, filed Jun. 19, 2012, Gonzales, et al.

U.S. Appl. No. 13/526,613, filed Jun. 19, 2012, Gonzales, et al.

U.S. Appl. No. 13/517,762, filed Jun. 14, 2012, Perez-Prat Vinuesa, et al.

U.S. Appl. No.13/621,858, filed Sep. 18, 2012, Gonzales, et al.

U.S. Appl. No. 13/621,860, filed Sep. 18, 2012, Perez-Prat Vinuesa, et al.

* cited by examiner

LIQUID CLEANING AND/OR CLEANSING COMPOSITION COMPRISING POLYURETHANE FOAM ABRASIVE PARTICLES

CROSS REFERENCE TO RELATED APPLICATION

This application claims the benefit of U.S. Provisional Application No. 61/326,290, filed Apr. 21, 2010 and of U.S. Provisional Application No. 61/424,852, filed Dec. 20, 2010.

TECHNICAL FIELD

The present invention relates to liquid compositions for cleaning and/or cleansing a variety of inanimate and animate surfaces, including hard surfaces in and around the house, dish surfaces, teeth, human and animal skin, car and vehicles surfaces, etc. More specifically, the present invention relates to liquid scouring composition comprising suitable particles for cleaning and/or cleansing.

BACKGROUND OF THE INVENTION

Scouring compositions such as particulate compositions or liquid (incl. gel, paste-type) compositions containing abrasive components are well known in the art. Such compositions are used for cleaning and/or cleansing a variety of surfaces; especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymeric beads like polypropylene, PVC, melamine, urea, polyacrylate and derivatives, and come in the form of liquid composition having a creamy consistency with the abrasive particles suspended therein.

The surface safety profile of such currently known scouring compositions is inadequate alternatively, poor cleaning performances is shown for compositions with an adequate surface safety profile. Indeed, due to the presence of very hard abrasive particles, these compositions can damage, i.e., scratch, the surfaces onto which they have been applied. Indeed, the formulator needs to choose between good cleaning/cleansing performance but featuring strong surface damage or compromising on the cleaning/cleansing performance while featuring acceptable surface safety profile. In addition, such currently known scouring compositions at least in certain fields of application (e.g., hard surface cleaning) are perceived by consumers as outdated.

It is thus an objective of the present invention to provide a liquid cleaning and/or cleansing composition suitable to clean/cleanse a variety of surfaces, including inanimate and animate surfaces, such hard surfaces in and around the house, dish surfaces, hard and soft tissue surface of the oral cavity, such as teeth, gums, tongue and buccal surfaces, human and animal skin, etc., wherein the composition provides good cleaning/cleansing performance, whilst providing a good surface safety profile.

It has been found that the above objective can be met by the composition according to the present invention.

It is an advantage of the compositions according to the present invention that they may be used to clean/cleanse inanimate and animate surfaces made of a variety of materials like glazed and non-glazed ceramic tiles, enamel, stainless steel, Inox®, Formica®, vinyl, no-wax vinyl, linoleum, melamine, glass, plastics, painted surfaces, human and animal skin, hair, hard and soft tissue surface of the oral cavity, such as teeth, gums, tongue and buccal surfaces, and the like.

A further advantage of the present invention is that in the compositions herein, the particles can be formulated at very low levels, whilst still providing the above benefits. Indeed, in general for other technologies, high levels of abrasive particles are needed to reach good cleaning/cleansing performance, thus leading to high formulation and process cost, difficult rinse and end cleaning profiles, as well as limitation for aesthetics and a pleasant hand feel of the cleaning/cleansing composition.

SUMMARY OF THE INVENTION

The present invention relates to a liquid cleaning and/or cleansing composition comprising polyurethane foam particles as abrasive and a suspending aid, wherein said polyurethane foam is formed from diisocyanate monomers and polyols; wherein said diisocyanate monomers are aromatic diisocyanate monomers and selected from the group consisting of toluene diisocyanate (TDI), methylene dianiline diisocyanate (MDI), polymeric forms of MDI, polymeric forms of TDI and mixtures thereof.

The present invention further encompasses a process of cleaning and/or cleansing a surface with a liquid, cleaning and/or cleansing composition comprising abrasive cleaning particles, wherein said surface is contacted with said composition, preferably wherein said composition is applied onto said surface.

DETAILED DESCRIPTION OF THE INVENTION

The Liquid Cleaning/Cleansing Composition

Figure 1A:
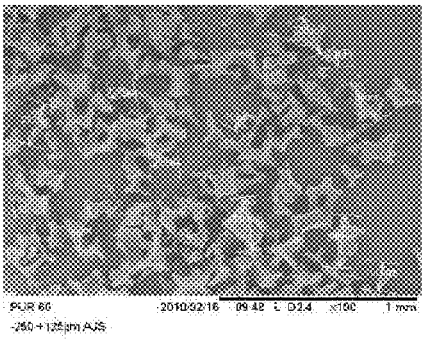
FIG. 1*a* is an electron microscopy image showing polyurethane particle A (density 60 kg/m$^3$) abrasive cleaning particles according to the present invention and FIG. 1*b* is an electron microscopy image showing polyurethane particle B (density 33 kg/m$^3$) abrasive cleaning particles according to the present invention.

The compositions according to the present invention are designed as cleaners/cleansers for a variety of inanimate and animate surfaces. Preferably, the compositions herein are suitable for cleaning/cleansing surfaces selected from the group consisting of inanimate surfaces, animate surfaces.

In a preferred embodiment, the compositions herein are suitable for cleaning/cleansing inanimate surfaces selected from the group consisting of household hard surfaces; dish surfaces; surfaces like leather or synthetic leather; and automotive vehicles surfaces.

In a highly preferred embodiment, the compositions herein are suitable to clean household hard surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "dish surfaces" it is meant herein any kind of surfaces found in dish cleaning, such as dishes, cutlery, cutting boards, pans, and the like. Such dish surfaces may be found both in private households as well as in commercial, institutional and industrial environments.

In an another preferred embodiment, the compositions herein are suitable for cleaning/cleansing animate surfaces selected from the group consisting of human skin; animal skin; human hair; animal hair; and teeth.

The compositions according to the present invention are liquid compositions as opposed to a solid or a gas. Liquid compositions include compositions having a water-like viscosity as well as thickened compositions, such as gels and pastes.

In a preferred embodiment herein, the liquid compositions herein are aqueous compositions. Therefore, they may comprise from 65% to 99.5% by weight of the total composition of water, preferably from 75% to 98% and more preferably from 80% to 95%.

In another preferred embodiment herein, the liquid compositions herein are mostly non-aqueous compositions although they may comprise from 0% to 10% by weight of the total composition of water, preferably from 0% to 5%, more preferably from 0% to 1% and most preferably 0% by weight of the total composition of water.

In a preferred embodiment herein, the compositions herein are neutral compositions, and thus have a pH, as is measured at 25° C., of 6-8, more preferably 6.5-7.5, even more preferably 7.

In another preferred embodiment compositions have pH preferably above pH 4 and alternatively have pH preferably below pH 9.

Accordingly, the compositions herein may comprise suitable bases and acids to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $Ca_2CO_3$, $Mg_2CO_3$, etc., alkanolamines (as e.g. monoethanolamine), urea and urea derivatives, polyamine, etc.

Typical levels of such bases, when present, are of from 0.01% to 5.0%, preferably from 0.05% to 3.0% and more preferably from 0.1% to 0.6% by weight of the total composition.

The compositions herein may comprise an acid to trim its pH to the required level, despite the presence of an acid, if any, the compositions herein will maintain their neutral to alkaline, preferably alkaline, pH as described herein above. A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from 0.01% to 5.0%, preferably from 0.04% to 3.0% and more preferably from 0.05% to 1.5% by weight of the total composition.

In a preferred embodiment according to the present invention the compositions herein are thickened compositions. Preferably, the liquid compositions herein have a viscosity of up to 7500 cps at 20 $s^{-1}$, more preferably from 5000 cps to 50 cps, yet more preferably from 2000 cps to 50 cps and most preferably from 1500 cps to 300 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another preferred embodiment according to the present invention the compositions herein have a water-like viscosity. By "water-like viscosity" it is meant herein a viscosity that is close to that of water. Preferably the liquid compositions herein have a viscosity of up to 50 cps at 60 rpm, more preferably from 0 cps to 30 cps, yet more preferably from 0 cps to 20 cps and most preferably from 0 cps to 10 cps at 60 rpm and 20° C. when measured with a Brookfield digital viscometer model DV II, with spindle 2.

Abrasive Cleaning Particles

The liquid cleaning and/or cleansing composition herein comprise abrasive cleaning particles formed by shearing and/or graining the polyurethane foam.

It has surprisingly been found that the abrasive cleaning particles of the present invention show a good cleaning performance even at relatively low levels, such as preferably from 0.1% to 20%, preferably from 0.1% to 10%, more preferably from 0.5% to 5%, even more preferably from 0.5% to 2%, by weight of the total composition of said abrasive cleaning particles.

The particles used in the present invention are preferably white and/or transparent. The color of particles can be changed by using suitable dyes and/or pigments. Additionally suitable color stabilizing agents can be used to stabilize desired color.

In a preferred embodiment the abrasive cleaning particles are preferably non-rolling. Alternatively in another preferred embodiment the abrasive cleaning particles are preferably sharp.

Indeed the applicant has found that non-rolling and/or sharp abrasive cleaning particles provide good soil removal.

The abrasive cleaning particles herein are non-spherical.

By "non spherical" it is meant herein, having a shape different from a sphere and having a Form Factor (FF) of below 0.75. Preferably, the abrasive cleaning particles herein have a Form Factor (FF) of below 0.6, most preferably below 0.50.

By "Form Factor (FF)" it is meant herein a dimensional indicator that defines how a given particle is different from a regular form of a sphere especially emphasizing irregular surface topology (e.g., surface roughness) as defined by ASTM F1877-05 (June 2009) chapter 11.3.6, wherein: $FF=4*\pi*\text{Surface Area}\div\text{Perimeter}^2$; with "Surface Area" meaning the surface area of a particle and "Perimeter" being the outer contour of the particle.

The non-spherical particles herein preferably have sharp edges and each particle has at least one edge or surface having concave curvature. More preferably, the non-spherical particles herein have a multitude of sharp edges and each particle has at least one edge or surface having concave curvature. The sharp edges of the non-spherical particles are defined by edge having a tip radius below 20 μm, preferably below 8 μm, most preferably below 5 μm. The tip radius is defined by the diameter of an imaginary circle fitting the curvature of the edge extremity.

Figure 1B:
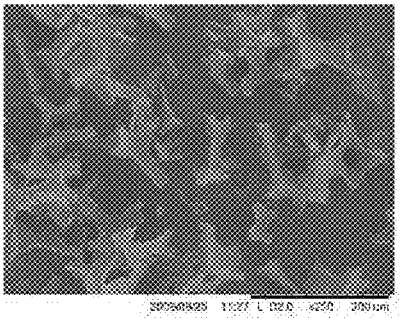

FIG. 1*a* is an electron microscopy image showing polyurethane particle A (density 60 kg/m$^3$) abrasive cleaning particles according to the present invention and FIG. 1*b* is an electron microscopy image showing polyurethane particle B (density 33 kg/m$^3$) abrasive cleaning particles according to the present invention.

Figure 2:
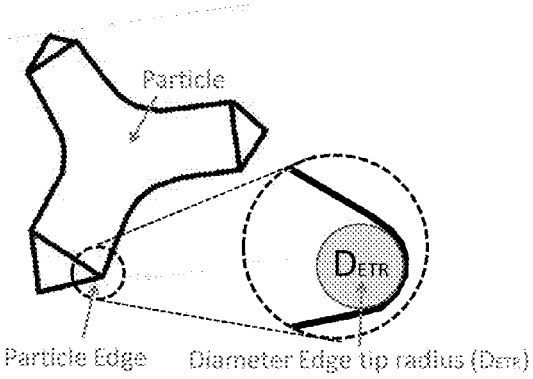
FIG. 2 is an illustration of tip radius.

FIG. 2 is an illustration of tip radius.

In a preferred embodiment, the abrasive cleaning particles have a mean ECD from 10 μm to 1000 μm, preferably from 50 μm to 500 μm, more preferably from 100 μm to 350 μm and most preferably from 150 to 250 μm.

The abrasive particle size is also critical to achieve efficient cleaning performance whereas excessively abrasive population with small particle sizes e.g.: typically below 10 micrometers feature polishing action vs. cleaning despite featuring a high number of particles per particle load in cleaner inherent to the small particle size. On the other hand, abrasive population with excessively high particle size, e.g.: above 1000 micrometers, do not deliver optimal cleaning efficiency, because the number of particles per particle load in cleaner, decreases significantly inherently to the large particle size. Additionally, excessively small particle size are not desirable in cleaner/for cleaning task since in practice, small and numerous particles are often hard to remove from the various surface topologies which requires excessive effort to remove from the user unless leaving the surface with visible particles residue. On the other hand, excessively large particle are too easily detected visually or provide bad tactile experience while handling or using the cleaner. Therefore, the applicants define herein an optimal particle size range that delivers both optimal cleaning performance and usage experience.

The abrasive particles have size defined by their area-equivalent diameter (ISO 9276-6:2008(E) section 7) also called Equivalent Circle Diameter ECD (ASTM F1877-05 Section 11.3.2). Mean ECD of particle population is calculated as the average of respective ECD of each particles of a particle population of at least 10 000 particles, preferably above 50 000 particles, more preferably above 100 000 particles after excluding from the measurement and calculation the data of particles having area-equivalent diameter (ECD) of below 10 micrometers. Mean data are extracted from volume-based vs. number-based measurements.

In a preferred embodiment abrasive cleaning particles are produced from the polyurethane foam, which is formed in the reaction between diisocyanate monomers and polyols, wherein the diisocyanate monomer can be aromatic and/or aliphatic, in the presence of catalyst, materials for controlling the cell structure and surfactants. Polyurethane foam can be made in a variety of densities and hardness's by varying the type of diisocyanate monomer(s) and polyols and by adding other substances to modify their characteristics. Other additives can be used to improve the stability of the polyurethane foam and other properties of the polyurethane foam. Polyurethane foam particles used for the present invention need to be hard enough to provide good cleaning properties without damaging the surface onto which the composition has been applied.

In one preferred example, the size of the abrasive cleaning particles used in the present invention is altered during usage especially undergoing significant size reduction. Hence the particle remain visible or tactile detectable in liquid composition and in the beginning of the usage process to provide effective cleaning. As the cleaning process progresses, the abrasive particles disperse or break into smaller particles and become invisible to an eye or tactile undetectable.

Though the properties of the polyurethane foam are determined mainly by the choice of the polyol, the disiocyanate has some influence. Polyurethane foams made from aromatic diisocyanates yellow with exposure to light, whereas those made from aliphatic diisocyanates are color-stable. Due the discoloration of the polyurethane foam containing aromatic diisocyanates, usage of color stabilizing agents like $Ti_2O_2$ is preferred. However applicant has discovered that by mixing aliphatic and aromatic diisocyanate monomers and keeping the aromatic diisocyanate monomer levels below 60% of the weight of the diisocyanates, preferably below 50% and more preferably below 40% of the weight of the diisocyanates, color-stable and polyurethane foam particles can be provided for the use as cleaning abrasives in the present invention.

Suitable diisocyanate monomers used herein are aromatic diisocyanate monomers preferably selected from the group consisting of toluene diisocyanate (TDI), methylene dianiline diisocyanate (MDI), polymeric forms of MDA, polymeric form of TDI, and mixtures thereof.

The choice of polyols is not having a great impact to the color stability of the foam, but more impact to the foam hardness and biodegradability.

Example of suitable polyols used herein are preferably selected from the group consisting of castor and/or soybean oil (including ethoxylated or propoxylated oils, including sulfated oils,); sugars and polysugars such as glucose, sucrose, dextrose, lactose, fructose, starch, cellulose; sugar alcohols such as glycol, glycerol, erythritol, thereitol, arabitol, xylitol, ribitol, mannitol, sorbitol, dulcitol, iditol, isomalt, maltitol, lactitol, polyglycitol and trimethylolpropane. Common useful polyols are also achieved by the reaction of previous polyols (including derivative from toluene dianiline) with diethanol amine and propylene oxide (a non-exhaustive example is "sucrose" propoxylate).

Other suitable polyols to be used herein are ethylene glycol and polymeric derivatives such as polyethylene glycol, propylene glycol and polymeric derivatives such as polypropylene glycol, tetratmethylene glycol and polymeric derivatives such as polytetramethylene glycol.

Polyester polyols are also suitable polyols and polyester polyols resulting from the reaction of acids (adipic, succinic, dodecandioc, azelaic, phtalic anhydride, isophthalic, terephtalic) and alcohols (ethylene glycol, 1,2 propylene glycol, 1,4 butane diol, 2-CH3-1,3-propane diol, neopentyl glycol, diethylene glycol, 1,6-hexanediol, trimethylol propane, glycerin). Non-exhaustive examples are polyethylenediol adipate, polypropylenediol adipate, polybutanediol adipate.

Other suitable polyols are hydrophobic types of polyols such as polyethylene terephtalate and co-polymers derivatives such as polytheylene terephtalate glycols, acrylic polyols, polycarbonate polyols, polyols derived from dimethyl carbonate reacted with polyols such as hexanediol, mannich polyols and amine terminated polyols and polycaprolactone polyols and mixtures thereof. Mixtures of previous alcohols are at times desirable to achieve the right chemical and mechanical properties of the polyurethane foams.

Preferable polyols used herein are selected from the group consisting of polypropylene glycol, polytetramethylene glycol having a molecular weight from 400 to 4000, soybean oil and castor oil and mixtures thereof.

Most preferable polyols are selected from the group consisting of ethylene glycol, glycerol, polyethylene glycol, polypropylene glycol, polytetramethylene glycol, polycaprolactonediol, poly(ethylene adipate)diol, poly(hexamethylene adipate)diol, castor oil, soy bean oil, sugars and polysugars and mixtures thereof.

The choice of polyol has effect on the biodegradability and the hardness of the polyurethane foam. For instance, in order to achieve the manufacture of biodegradable foams, preferable selection of polyols are hydrophilic polyols such as ethyleneglycol-based or caprolactone-based-polyols and/or polyols containing cleavable ester or carboxylic anhydride function such as adipate-based polyols, optionally mixed with natural polyols such as sugars and sugar alcohol derivatives, castor oil and mixtures thereof.

In one preferred embodiment the biodegradable polyurethane foam is prepared by the using polyols having molecular weight from 400 to 4000 and selected from the group consisting of polycaprolactonediol, polyethyleneglycol, poly (ethylene adipate) diol, poly (hexamethylene adipate) diol and mixtures thereof.

In another preferred embodiment biodegradable polyurethane foam is prepared by reacting polyols selected from the group consisting of polycaprolactonediol, polyethyleneglycol, poly(ethylene adipate) diol, poly (hexamethylene adipate) diol and mixtures thereof with polymeric MDI, which does not contain MDI monomers, to minimize the production of harmful monomer e.g. methylene dianiline monomer (MDA), which is a result of the decomposition of the abrasive particles. Alternatively preferable way to prepare biodegradable polyurethane foam is reacting polyols selected from the group consisting of polycaprolactonediol, polyethyleneglycol, poly(ethylene adipate) diol, poly (hexamethylene adipate) diol and mixtures thereof with polymeric TDI, which does not contain TDI monomers, to minimize the production of harmful monomer e.g. toluenediamide (TDA), which is a result of the decomposition if the abrasive particles.

Another preferred way to prepare biodegradable polyurethane foam is to react polyols selected from the group consisting of polycaprolactonediol, polyethyleneglycol, poly (ethylene adipate) diol, poly (hexamethylene adipate) diol and mixtures thereof with urethanized/carbodiimidized MDI or polymeric MDI, which does not contain MDI monomers to minimize the production of harmful monomer e.g.: methylene dianiline monomer (MDA). Another preferred way to prepare biodegradable polyurethane foam is to react polyols selected from the group consisting of polycaprolactonediol, polyethyleneglycol, poly(ethylene adipate) diol, poly (hexamethylene adipate) diol and mixtures thereof with urethanized/carbodiimidized polymeric TDI, which does not contain TDI monomers, to minimize the production of harmful monomer e.g. toluenediamide (TDA).

By the terms polymeric form of MDI and polymeric form of TDI, it is meant polymeric forms of MDI and TDI diisocyanates having isocyanate functionality above 2.4, more preferably above 2.7 and most preferably above 3. Additionally, polymeric forms of MDI and TDI diisocyanates have preferably a viscosity above 200 cps, more preferably above 400 cps, most preferably above 700 cps measured at 25 Deg.C. with standard Brookfield method) whereas the polymeric form of diisocyanate does not contain monomer of MDI or TDI.

In another preferred embodiment biodegradable polyurethane foam is prepared by reacting hydrophobic pre-polymerized diisocyanates, e.g.: pre-reacted MDI and/or pre-reacted TDI or polymeric MDI and/or polymeric TDI with hydrophobic polyols and reacting the pre-polymerized diisocyanate with hydrophilic and/or biodegradable polyols.

By the term pre-polymerized diisocyanates, it is meant products of reaction wherein polyol has been reacted with excess of diisocyanate. Alternatively these pre-polymers can be subsequently urethanized and/or carbodiimidized.

Examples of pre-polymerized diisocyanates are MDI or polymerized MDI pre-reacted with polyethylene terephtalate and co-polymer derivatives such as polytheylene terephtalate glycols, acrylic polyols, polycarbonate polyols, polyols derived from dimethyl carbonate reacted with polyols such as hexanediol, mannich polyols and amine terminated polyols, and polytetramethyle glycol, polyhexamethylene glycol or polydecamethylene glycol. Example of preferred hydrophilic or biodegradable polyols are ethyleneglycol-based or caprolactone-based-polyols and/or polyols containing cleavable ester or carboxylic anhydride function such as adipate-based polyols, optionally mixed with natural polyols such as sugars and sugar alcohol derivatives, cellulose derivative, castor oil and mixtures thereof.

Alternatively use of low molecular weight polyols with rigid molecular structure will increase the overall hardness of the polyurethane foam. Typically useful polyols to produce hard polyurethane foams have average molecular weight (Mw) below 2000, preferably below 1500 and more preferably below 1000. Especially the use of sucrose, ethylene glycol, glycerol, polyethylene glycol (Mw<400) and mixtures thereof is preferred.

Alternatively, the addition of bioactive or biodegradable material during the foaming process is also a mean to achieve sufficient biodegradability of the resulting polyurethane foam. Especially, the addition of lignin, molasses, polyhydroxyalkanoates, polylactide, polycaprolactone, or aminoacid are especially preferred.

Similarly, in order to increase the hardness of the polyurethane foam, the use of polyols with high alcohol (or amine) function content is preferred. Polyols functionality defined by the OH number in mg KOH/g polyol is above 150, preferably above 200, most preferably above 300.

Hydrolytic stability is preferred feature of the polyurethane foam when compositions are formulated in pH below 4 and in pH above 9. Preferably polyols to provide hydrolytic stability are polycarbonates.

Additionally abrasive cleaning particles can be produced from the polyurethane foam, which is formed from the mixture of aromatic diisocyanate and aliphatic diisocyanate monomers and polyols. Suitable aliphatic diisocyanates are selected from the group consisting of hexamethylen diisocyanate (HDI), dicyclohexyl methane diisocyanate (H12MDI), isophorone diisocyanate (IPI), Lysine or lysine ester diisocynate (LDI), trimers of previous and mixtures thereof.

There are two main polyurethane foam variants: one in which most of the foam cells remain closed, and the gas(es) remains trapped, the other being systems which have mostly open cells. In present invention open cell structure is preferred foam variant with minimum pending wall membrane residual. The desired cell structure is directly linked to the optimal particle size desired as per the application e.g.: large cell size is more suitable to achieve larger particle sizes and vice-et-versa.

Figure 3A:
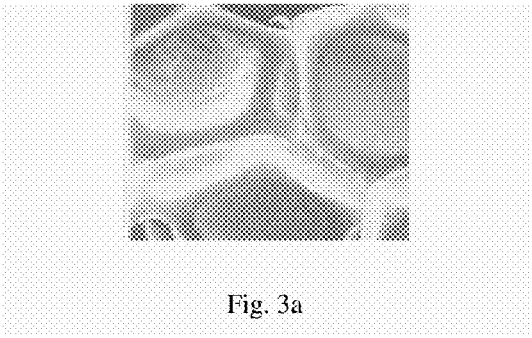
FIG. 3*a* is an electron image showing closed cell polyurethane foam with wall membrane and FIG. 3*b* is an electron microscopy image showing open cell polyurethane foam without wall membrane according to present invention.
Figure 3B:
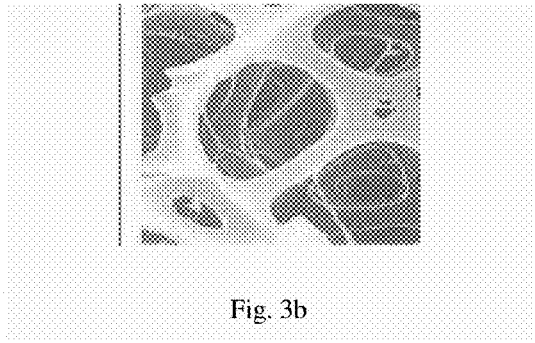

FIG. 3*a* is an electron microscopy image showing closed cell polyurethane foam with wall membrane and FIG. 3*b* is an electron microscopy image showing open cell polyurethane foam without wall membrane according to the present invention.

The applicant has found that good cleaning effect will be achieved with the abrasive particles, which have been made from the polyurethane foam having density above 100 kg/m$^3$, and even up to 500 kg/m$^3$. However the applicant has surprisingly found that significantly better cleaning effect can be achieved with the polyurethane foam density is below 100 kg/m$^3$, more preferably from 50 kg/m$^3$ to 100kg/m$^3$ and most preferably from 50 kg/m$^3$ to 5 kg/m$^3$.

Preferred abrasive cleaning particles suitable for used herein are hard enough to provide good cleaning/cleansing performance, whilst providing a good surface safety profile.

Preferred abrasive cleaning particles in the present invention have hardness from 3 to 50 kg/mm$^2$, preferably from 4 to 25 kg/mm$^2$ and most preferably from 5 to 15 kg/mm$^2$ on the HV Vickers hardness.

Vickers Hardness Test Method:

Vickers hardness HV is measured at 23° C. according to standard methods ISO 14577-1, ISO 14577-2, ISO 14577-3. The Vickers hardness is measured from a solid block of the raw material at least 2 mm in thickness. The Vickers hardness micro indentation measurement is carried out by using the Micro-Hardness Tester (MHT), manufactured by CSM Instruments SA, Peseux, Switzerland.

As per the ISO 14577 instructions, the test surface should be flat and smooth, having a roughness (Ra) value less than 5% of the maximum indenter penetration depth. For a 200 μm maximum depth this equates to a Ra value less than 10 μm. As per ISO 14577, such a surface may be prepared by any suitable means, which may include cutting the block of test material with a new sharp microtome or scalpel blade, grinding, polishing or by casting melted material onto a flat, smooth casting form and allowing it to thoroughly solidify prior testing.

Suitable general settings for the Micro-Hardness Tester (MHT) are as follows:

Control mode: Displacement, Continuous
Maximum displacement: 200 μm
Approach speed: 20 nm/s
Zero point determination: at contact
Hold period to measure thermal drift at contact: 60 s
Force application time: 30 s
Frequency of data logging: at least every second
Hold time at maximum force: 30 s
Force removal time: 30 s
Shape/Material of intender tip: Vickers Pyramid Shape/Diamond Tip Alternatively, the abrasive cleaning particles in the present invention hardness may also expressed accordingly to the MOHS hardness scale. Preferably, the MOHS hardness is comprised between 0.5 and 3.5 and most preferably between 1 and 3. The MOHS hardness scale is an internationally recognized scale for measuring the hardness of a compound versus a compound of known hardness, see Encyclopedia of Chemical Technology, Kirk-Othmer, 4 th Edition Vol 1, page 18 or Lide, D. R (ed) CRC Handbook of Chemistry and Physics, 73 rd edition, Boca Raton, Fla.: The Rubber Company, 1992-1993. Many MOHS Test kits are commercially available containing material with known MOHS hardness. For measurement and selection of abrasive material with selected MOHS hardness, it is recommended to execute the MOHS hardness measurement with un-shaped particles e.g.: with spherical or granular forms of the abrasive material since MOHS measurement of shape particles will provide erroneous results.

Preferred foam hardness is preferably achieved by selecting low $M_w$ reactants, especially low $M_w$ polyols, by increasing crosslinking density by using high functionality polyols, by use of excess of diisocyanate and/or by use of appropriate catalyst to favor reaction of diisocyanate.

The polyurethane foam used for the present invention has preferably a no-detectable phase transition (e.g.; glass transition or melting temperature) or a phase transition temperature significantly higher that the usage temperature. Preferably the phase transition temperature is at least 20° C. preferably 40 degree ° C. above usage temperature.

The foam obtained is thereafter reduced to the abrasive cleaning particles according to the present invention wherein, the abrasive cleaning particles have a mean ECD of at least 10 μm by any suitable means.

In order to favor the reduction of the foam into particle, the foam has preferable sufficient brittleness, e.g.: upon stress, the foam has little tendency to deform and is liable to fracture. Typically the increase of crosslinking, decreasing of MW weight of the polyols, and/or the increase of the polyurethane crystallinity yield very brittle foam.

In one preferred example, the abrasive polyurethane particles used in the present invention remain visible when liquid composition is stored into a container while during the effective cleaning process, abrasive particles disperse or break into smaller particles and become invisible to a eye.

One suitable way of reducing the foam to the abrasive cleaning particles herein is to grind or mill the foam. Other suitable means include the use of eroding tools such as a high speed eroding wheel with dust collector wherein the surface of the wheel is engraved with a pattern or is coated with abrasive sandpaper or the like to promote the foam to form the abrasive cleaning particles herein.

Alternatively and in a highly preferred embodiment herein, the foam may be reduced to particles in several stages. First the bulk foam can be broken into pieces of a few cm dimensions by manually chopping or cutting, or using a mechanical tool such as a lumpbreaker, for example the Model 2036 from S Howes, Inc. of Silver Creek, N.Y. In a second stage, the lumps are agitated using a propeller or saw toothed disc dispersing tool, which causes the foam to release entrapped water and form liquid slurry of polymer particles dispersed in aqueous phase. In a third stage, a high shear mixer (such as the Ultra Turrax rotor stator mixer from IKA Works, Inc., Wilmington, N.C.) can be employed to reduce the particle size of the primary slurry to that required for cleaning particles.

Preferably the abrasive cleaning particles obtained via grinding or milling operation are single particles, which do not have cell structure.

Suspending Aid

The abrasive cleaning particles present in the composition herein are solid particles in a liquid composition. Said abrasive cleaning particles may be suspended in the liquid composition. However, it is well within the scope of the present invention that such abrasive cleaning particles are not-stably suspended within the composition and either settle or float on top of the composition. In this case, a user may have to temporally suspend the abrasive cleaning particles by agitating (e.g., shaking or stirring) the composition prior to use.

However, it is preferred herein that the abrasive cleaning particles are stably suspended in the liquid compositions herein. Thus the compositions herein comprise a suspending aid.

The suspending aid herein may either be a compound specifically chosen to provide a suspension of the abrasive cleaning particles in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in cleaning/cleansing compositions and other detergent or cosmetic compositions may be used herein. Indeed, suitable organic suspending aids include polysaccharide polymers. In addition or as an alternative, polycarboxylate polymer thickeners may be used herein. Also, in addition or as an alternative of the above, layered silicate platelets e.g.: Hectorite, bentonite or montmorillonites can also be used.

Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum, succinoglucan gum, or derivatives thereof, or mixtures thereof. Xanthan gum is commercially available from Kelco under the tradename Kelzan T.

Preferably the suspending aid herein is Xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between 0.1% to 5%, more preferably 0.5% to 2%, even more preferably 0.8% to 1.2%, by weight of the total composition.

Optional Ingredients

The compositions according to the present invention may comprise a variety of optional ingredients depending on the technical benefit aimed for and the surface treated.

Suitable optional ingredients for use herein include chelating agents, surfactants, radical scavengers, perfumes, surface-modifying polymers, solvents, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Organic Solvent

As an optional but highly preferred ingredient the composition herein comprises an organic solvents or mixtures thereof.

The compositions herein comprise from 0% to 30%, more preferably about 1.0% to about 20% and most preferably, about 2% to about 15% by weight of the total composition of an organic solvent or a mixture thereof.

Suitable solvents can be selected from the group consisting of: aliphatic alcohols, ethers and diethers having from about 4 to about 14 carbon atoms, preferably from about 6 to about 12 carbon atoms, and more preferably from about 8 to about 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred.

Aliphatic alcohols, of the formula R—OH wherein R is a linear or branched, saturated or unsaturated alkyl group of from about 1 to about 20 carbon atoms, preferably from about 2 to about 15 and more preferably from about 5 to about 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—$CR_1R_2$—OH wherein R1 and R2 are independently H or a $C_2$-$C_{10}$ saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal $C_3$-$C_6$ hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from about 1 to about 20 carbon atoms, preferably from about 2 to about 15 and more preferably from about 2 to about 10, wherein A is an alkoxy group preferably butoxy, propoxy and/or ethoxy, and n is an integer of from about 1 to about 5, preferably about 1 to about 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from about 1 to about 20 carbon atoms, preferably from about 1 to about 15 and more preferably from about 1 to about 10. For example a suitable aromatic alcohol to be used herein is benzyl alcohol.

Surfactants

The compositions herein may comprise a nonionic, anionic, zwitterionic, cationic and amphoteric surfactant or mixtures thereof. Suitable surfactants are those selected from the group consisting of nonionic, anionic, zwitterionic, cationic and amphoteric surfactants, having hydrophobic chains containing from 8 to 18 carbon atoms. Examples of suitable surfactants are described in McCutcheon's Vol. 1: Emulsifiers and Detergents, North American Ed., McCutcheon Division, MC Publishing Co., 2002.

Preferably, the composition herein comprises from 0.01% to 20%, more preferably from 0.5% to 10%, and most preferably from 1% to 5% by weight of the total composition of a surfactant or a mixture thereof.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous compositions comprise from 0.01% to 20%, more preferably from 0.5% to 10%, and most preferably from 1% to 5% by weight of the total composition of a non-ionic surfactant or a mixture thereof.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail, and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A most preferred alkyl ethoxylate is $C_{9-11}$ $EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from 10 carbon atoms to 16 carbon atoms in the hydrophobic tail, are beneficial because of their strong cleaning profile and effectiveness even at levels below 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma.

Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8-9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), $C_{12}$-$C_{18}$ alkyl polyethoxylate (4.0) sulfate ($C_{12}$-$C_{18}$E, (4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

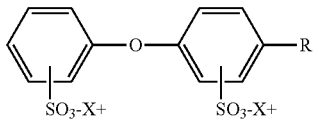

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14}$-$C_{16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like can be used. Some common examples of these detergents are described in the patent literature: U.S. Pat. Nos. 2,082,275, 2,702,279 and 2,255,082. A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants.

One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Dye

The liquid compositions according to the present invention may be coloured. Accordingly, they may comprise a dye or a mixture thereof.

Delivery Form of the Compositions

The compositions herein may be packaged in a variety of suitable packaging known to those skilled in the art, such as plastic bottles for pouring liquid compositions, squeeze bottles or bottles equipped with a trigger sprayer for spraying liquid compositions. Alternatively, the paste-like compositions according to the present invention may by packaged in a tube.

In an alternative embodiment herein, the liquid composition herein is impregnated onto a substrate, preferably the substrate is in the form of a flexible, thin sheet or a block of material, such as a sponge.

Suitable substrates are woven or non-woven sheets, cellulosic material based sheets, sponge or foam with open cell structures e.g.: polyurethane foams, cellulosic foam, melamine foam, etc.

The Process of Cleaning a Surface

The present invention encompasses a process of cleaning and/or cleansing a surface with a liquid composition according to the present invention. Suitable surfaces herein are described herein above under the heading "The liquid cleaning/cleansing composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the liquid composition according to the present invention from a container containing said liquid composition and thereafter cleaning and/or cleansing said surface.

The composition herein may be in its neat form or in its diluted form.

By "in its neat form", it is to be understood that said liquid composition is applied directly onto the surface to be treated without undergoing any dilution, i.e., the liquid composition herein is applied onto the surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

The composition herein may be applied using an appropriate implement, such as a mop, paper towel, brush (e.g., a toothbrush) or a cloth, soaked in the diluted or neat composition herein. Furthermore, once applied onto said surface said composition may be agitated over said surface using an appropriate implement. Indeed, said surface may be wiped using a mop, paper towel, brush or a cloth.

The process herein may additionally contain a rinsing step, preferably after the application of said composition. By "rinsing", it is meant herein contacting the surface cleaned/cleansed with the process according to the present invention with substantial quantities of appropriate solvent, typically water, directly after the step of applying the liquid composition herein onto said surface. By "substantial quantities", it is meant herein between 0.01 lt. and 1 lt. of water per $m^2$ of surface, more preferably between 0.1 lt. and 1 lt. of water per $m^2$ of surface.

In a highly preferred embodiment herein, process of cleaning/cleansing is a process of cleaning household hard surfaces with a liquid composition according to present invention.

EXAMPLES

These following compositions were made comprising the listed ingredients in the listed proportions (weight %). Examples 1-43 herein are met to exemplify the present invention but are not necessarily used to limit or otherwise define the scope of the present invention.

Hard surface cleaner Bathroom composition:

| % Weight | 1 | 2 | 3 |
|---|---|---|---|
| C9-C11 EO8 (Neodol 91-8 ®) | 3 | 2.5 | 3.5 |
| Alkyl Benzene sulfonate | | 1 | |
| C12-14-dimethyl Aminoxide | | 1 | |
| n-Butoxy Propoxy Propanol | | 2 | 2.5 |
| Hydrogene Peroxide | 3 | | |
| Hydrophobic ethoxylated polyurethane (Acusol 882 ®) | 1.5 | 1 | 0.8 |
| Lactic Acid | 3 | | 3.5 |
| Citric Acid | | 3 | 0.5 |
| Polysaccharide (Xanthan Gum, Keltrol CG-SFT ® Kelco) | 0.25 | 0.25 | 0.25 |
| Perfume | 0.35 | 0.35 | 0.35 |
| Polyurethane foam particles as abrasive cleaning particles from the foam having foam density 33 kg/$m^3$/ Vickers hardness 7 kg/$mm^2$/Blade mill grinded and sieved fraction 50-250 μm) | 1 | 1 | 1 |
| Water | Balance | Balance | Balance |

-continued

Hard surface cleaner Bathroom composition:

| % Weight | 4 | 5 | 6 |
|---|---|---|---|
| Chloridric acid | 2 | | |
| Linear C10 alkyl sulphate | 1.3 | 2 | 3 |
| n-Butoxy Propoxy Propanol | 2 | | 1.75 |
| Citric Acid | | 3 | 3 |
| PolyvinylPyrrolidone (Luviskol K60 ®) | 0.1 | 0.1 | 0.1 |
| NaOH | | 0.2 | 0.2 |
| Perfume | 0.4 | 0.4 | 0.4 |
| Polysaccharide (Xanthan Gum Kelzan T ®, Kelco) | 0.3 | 0.35 | 0.35 |
| Polyurethane foam particles as abrasive cleaning particles from the foam having foam density 33 kg/$m^3$/ Vickers hardness 7 kg/$mm^2$/Blade mill grinded and sieved fraction 50-250 μm) | 2 | 2 | 2 |
| Water | Balance | Balance | Balance |

Hand-dishwashing detergent compositions:

| % Weight | 7 | 8 | 9 |
|---|---|---|---|
| N-2-ethylhexyl sulfocuccinamate | 3 | 3 | 3 |
| C11EO5 | 7 | 14 | |
| C11-EO7 | | | 7 |
| C10-EO7 | 7 | | 7 |
| Trisodium Citrate | 1 | 1 | 1 |
| Potassium Carbonate | 0.2 | 0.2 | 0.2 |
| Perfume | 1 | 1 | 1 |
| Polysaccharide (Xanthan Gum Kelzan T ®, Kelco) | 0.35 | 0.35 | 0.35 |
| Polyurethane foam particles as abrasive cleaning particles from the foam having foam density 35 kg/$m^3$/ Vickers hardness 7 kg/$mm^2$/Blade mill grinded and sieved fraction 50-150 μm) | 2 | 2 | 2 |
| Water (+minor e.g.; pH adjusted to 10.5) | Balance | Balance | Balance |

General degreaser composition:

| % Weight | 10 | 11 |
|---|---|---|
| C9-C11 EO8 (Neodol 91-8 ®) | 3 | 3 |
| N-Butoxy Propoxy Propanol | 15 | 15 |
| Ethanol | 10 | 5 |
| Isopropanol | | 10 |
| Polysaccharide (Xanthan Gum-glyoxal modified Optixan-T) | 0.35 | 0.35 |
| Polyurethane foam particles as abrasive cleaning particles from the foam having foam density 33 kg/$m^3$/ Vickers hardness 7 kg/$mm^2$/Blade mill grinded and sieved fraction 50-250 μm) | 1 | 1 |
| Water (+minor e.g.; pH adjusted to alkaline pH) | Balance | Balance |

Scouring composition:

| % Weight | 12 | 13 | 14 |
|---|---|---|---|
| Sodium C13-16 prafin sulfonate | 2.5 | 2.5 | 2.5 |
| C12-14-EO7 (Lutensol AO7 ®) | 0.5 | 0.5 | 0.5 |
| Coconut Fatty Acid | 0.3 | 0.3 | 0.3 |
| Sodium Citrate | 3.3 | 3.3 | 3.3 |
| Sodium Carbonate | 3 | 3 | 3 |
| Orange terpenes | 2.1 | 2.1 | 2.1 |
| Benzyl Alcohol | 1.5 | 1.5 | |
| Polyacrylic acid 1.5 Mw | 0.75 | 0.75 | 0.75 |
| Diatomaceous earth (Celite 499 ® median size 10 μm) | 25 | | |
| Calcium Carbonate (Merk 2066 ® median size 10 μm) | | 25 | |
| Polyurethane foam particles as abrasive cleaning particles from the foam having foam density 33 kg/m$^3$/ Vickers hardness 7 kg/mm$^2$/Blade mill grinded and sieved fraction 50-250 μm) | 5 | 5 | 5 |
| Water | Balance | Balance | Balance |

Liquid glass cleaner:

| % Weight | 15 | 16 |
|---|---|---|
| Butoxypropanol | 2 | 4 |
| Ethanol | 3 | 6 |
| C12-14 sodium sulphate | 0.24 | |
| NaOH/Citric acid | To pH 10 | |
| Citric Acid | | |
| Polyurethane foam particles as abrasive cleaning particles from the foam having foam density 33 kg/m$^3$/Vickers hardness 7 kg/mm$^2$/Blade mill grinded and sieved fraction 10-50 μm) | 0.5 | 0.5 |
| Water (+minor) | Balance | Balance |

Cleaning wipe (Body cleansing wipe):

| % Weight | 17 | 18 | 19 |
|---|---|---|---|
| C10 Amine Oxide | — | 0.02 | — |
| C12, 14 Amine Oxide | 0.4 | — | — |
| Betaine (Rewoteric AM CAS 15 U) | — | — | 0.2 |
| C9, 11 A5EO (Neodol E 91.5) | — | 0.1 | — |
| C9, 11 A8EO (Neodol E 91.8) | — | — | 0.8 |
| C12, 14 A5EO | 0.125 | — | — |
| 2-Ethyl Hexyl Sulphate | — | 0.05 | 0.6 |
| Silicone | 0.001 | 0.003 | 0.003 |
| EtOH | 9.4 | 8.0 | 9.5 |
| Propylene Glycol Butyl Ether | 0.55 | 1.2 | — |
| Geraniol | — | — | 0.1 |
| Citric acid | 1.5 | — | — |
| Lactic acid | — | | 1.5 |
| Perfume | 0.25 | 0.15 | 0.15 |
| Polyurethane foam particles as abrasive cleaning particles from the foam having foam density 33 kg/m$^3$/ Vickers hardness 7 kg/mm$^2$/Blade mill grinded and sieved fraction 50-250 μm) | 5 | 3 | 3 |
| Nonwoven: Spunlace 100% viscose 50 gsm (lotion loading fact) | | | (x3.5) |
| Nonwoven: Airlaid walkisoft (70% cellulose, 12% Viscose, 18% binder) 80 gsm (lotion loading factor) | | (x3.5) | |
| Carded thermobonded (70% polypropylene, 30% rayon), 70 gsm (Lotion loading factor) | (x3.5) | | |

Cleaning wipe (Body cleansing wipe):

| % Weight | 20 |
|---|---|
| Benzalkonioum Chloride (Alkaquat DMB-451 ®) | 0.1 |
| Cocamine Oxide (C10/C16 alkyl dimethyl amine oxide; AO-1214 LP supplied by Procter & Gamble Co.) | 0.5 |
| Pyroglutamic Acid (pidolidone) (2-pyrrolidone-5 carboxylic acid) | 4 |
| Ethanol-denatured 200 proof (SD alcohol 40) | 10 |
| DC Antiform H-10 (dimethicone) | 0.03 |
| Sodium Benzoate | 0.2 |
| Tetrasodium EDTA (Hampene 220 ®) | 0.1 |
| Sodium Chloride | 0.4 |
| Perfume | 0.01 |
| Polyurethane foam particles as abrasive cleaning particles from the foam having foam density 33 kg/m$^3$/Vickers hardness 7 kg/mm$^2$/Blade mill grinded and sieved fraction 50-250 μm) | 2 |
| Water and minors | balance |

The above wipes lotion composition is loaded onto a water-insoluble substrate, being a patterned hydroentangled non-woven substrate having a basis weight of 56 gms comprising 70% polyester and 30% rayon approximately 6.5 inches wide by 7.5 inches long with a caliper of about 0.80 mm. Optionally, the substrate can be pre-coated with dimethicone (Dow Corning 200 Fluid 5cst) using conventional substrate coating techniques. Lotion to wipe weight ratio of about 2:1 using conventional substrate coating techniques.

Oral care composition (toothpaste):

| % Weight | 20 | 21 |
|---|---|---|
| Sorbitol (70% sol.) | 24.2 | 24.2 |
| Glycerin | 7 | 7 |
| Carboxymethylcellulose | 0.5 | 0.5 |
| PEG-6 | 4 | 4 |
| Sodium Fluoride | 0.24 | 0.24 |
| Sodium Saccharine | 0.13 | 0.13 |
| Mono Sodium phosphate | 0.41 | 0.41 |
| Tri Sodium phosphate | 0.39 | 0.39 |
| Sodium Tartrate | 1 | 1 |
| TiO2 | 0.5 | 0.5 |
| Silica | 35 | |
| Sodium lauroyl sarcosinate (95% active) | 1 | 1 |
| Flavor | 0.8 | 0.8 |
| Polyurethane foam particles as abrasive cleaning particles from the foam having foam density 33 kg/m$^3$/ Vickers hardness 7 kg/mm$^2$/Blade mill grinded and sieved fraction 10-30 μm) | 2 | 5 |
| Water | Balance | Balance |

Body Cleansing composition:

| % Weight | 22 | 23 |
|---|---|---|
| Cocoamidopropyl betaine | 5.15 | 5.15 |
| Sodium Laureth sulfate | 5.8 | 5.8 |
| Sodium Lauroyl sarcosinate | 0.5 | 0.5 |
| Polyquaternium 10 | 0.1 | 0.1 |
| C12-14 fatty alcohol | 0.45 | 0.45 |
| Zinc Stearate | 1.5 | 1.5 |
| Glycol DiStearate | 0.25 | 0.25 |
| Sodium lauryl sulfate | 0.53 | 0.53 |
| Cocamidopropyl betaine | 0.17 | 0.17 |
| Lauramide Diethanolamide | 0.48 | 0.48 |
| Sodium sulfate | 0.05 | 0.05 |
| Citric Acid | 0.05 | 0.05 |

-continued

Body Cleansing composition:

| % Weight | 22 | 23 |
|---|---|---|
| DMDM hydantoin (1,3-Dimethylol-5,5-dimethylhydantoin Glydant) | 0.2 | 0.2 |
| Tetra Sodium EDTA | 0.1 | 0.1 |
| Fragance | 0.5 | 0.5 |
| Polysaccharide (Xanthan Gum-glyoxal modified Optixan-T) | 0.2 | 0.2 |
| Polyurethane foam particles as abrasive cleaning particles from the foam having foam density 33 kg/m$^3$/Vickers hardness 7 kg/mm$^2$/Blade mill grinded and sieved fraction 50-250 μm) | 2 | 1 |
| Water and minors | | 1 |
| Water | Balance | Balance |

Facial Cleansing Compositions

| Ingredients | 24 | 25 | 26 | 27 |
|---|---|---|---|---|
| Acrylates Copolymer[1] | 1.50 | 2.0 | 1.25 | — |
| Acrylates/$C_{10-30}$ alkyl acrylate crosspolymer[2] | — | — | — | 1.0 |
| Sodium Lauryl Sulfate | 2.0 | — | — | — |
| Sodium Laureth Sulfate | 8.0 | — | — | — |
| Ammonium Lauryl Sulfate | — | 6.0 | — | — |
| Sodium Trideceth Sulfate | — | — | 3.0 | 2.5 |
| Sodium Myristoyl Sarcosinate | — | 2.0 | 3.0 | 2.5 |
| Sodium Lauroamphoacetate[3] | — | — | 6.0 | 5.0 |
| Sodium Hydroxide* | pH >6 | — | — | — |
| Triethanolamine* | — | pH >6 | — | pH 5.2 |
| Cocamidopropyl Betaine | 4.0 | 7.0 | — | — |
| Glycerin | 4.0 | 5.0 | 2.0 | 2.0 |
| Sorbitol | — | — | 2.0 | 2.0 |
| Salicylic Acid | — | — | 2.0 | 2.0 |
| Fragrance | 0.1 | 0.1 | 0.1 | 0.1 |
| Preservative | 0.3 | 0.3 | 0.15 | 0.15 |
| Polyurethane foam particles as abrasive cleaning particles from the foam having foam density 33 kg/m$^3$/Vickers hardness 7 kg/mm$^2$/Blade mill grinded and sieved fraction 50-250 μm) | 1.0 | 1.0 | 2.0 | 2.0 |
| PEG 120 Methyl Glucose Trioleate[4] | 0.5 | — | 0.25 | 0.25 |
| PEG 150 Pentaerythrityl Tetrastearate[5] | — | 0.40 | — | — |
| Citric Acid** | pH 5.5 | pH 5.5 | pH 5.5 | pH 5.5 |
| Water | QS to 100% | QS to 100% | QS to 100% | QS to 100% |

*per the supplier use directions, the base is used to activate the acrylates copolymer

**acid can be added to adjust the formula to a lower pH

[1]Carbopol Aqua SF-1 ® from Noveon ™, Inc.

[2]Carbopol Ultrez 21 ® from Noveon ™, Inc.

[3]Miranol ® Ultra L32 from Rhodia

[4]Glucamate LT ® from Chemron

[5]Crothix ® from Croda

Examples 24 to 27 are made the following way:

Add Carbopol® to de-ionized free water of the formulation. Add all surfactants except cationics and betaines. If the pH is less than 6 then add a neutralizing agent (typically a base i.e., Triethanolamine, sodium hydroxide) to adjust to a pH greater than 6. If necessary, apply gentle heat to reduce viscosity and help minimize air entrapment. Add betaine and/or cationic surfactants. Add conditioning agents, additional rheology modifiers, pearlizing agents, encapsulated materials, exfoliants, preservatives, dyes, fragrances, abrasive particles and other desirable ingredients. Lastly, if desired reduce the pH with an acid (i.e. citric acid) and increase viscosity by adding sodium chloride.

| Oral care composition (toothpaste) | | | | | |
|---|---|---|---|---|---|
| | 28 | 29 | 30 | 31 | 32 |
| Sodium Gluconate | 1.064 | 1.064 | 1.064 | 1.064 | 0.600 |
| Stannous fluoride | 0.454 | 0.454 | 0.454 | 0.454 | 0.454 |
| Sodium fluoride | | | | | |
| Sodium monofluorophosphate | | | | | |
| Zinc Lactate | 0.670 | 0.670 | 0.670 | 0.670 | 2.500 |
| Glycerin | — | — | — | — | 36.000 |
| Polyethylene glycol 300 | | | | | 7.000 |
| Propylene Glycol | | | | | 7.000 |
| Sorbitol(LRS) USP | 39.612 | 39.612 | 39.612 | 39.612 | — |
| Sodium lauryl sulfate solution (28%) | 5.000 | 5.000 | 5.000 | 5.000 | 3.500 |
| Polyurethane foam particles as abrasive cleaning particles from the foam having foam density 33 kg/m$^3$/Vickers hardness 7 kg/mm$^2$/Blade mill grinded and sieved fraction 50-250 μm) | 10.000 | 10.000 | 1.000 | 5.000 | 5.000 |
| Zeodent 119 | — | — | — | — | — |
| Zeodent 109 | | | 10.000 | 10.000 | 10.000 |
| Hydrogen peroxide (35% soln) | | | | | |
| Sodium hexametaphosphate | — | — | — | — | 13.000 |
| Gantrez | | 2.000 | 2.000 | 2.000 | — |
| Natural CaCO3-600M | — | — | — | — | — |
| Sodium phosphate (mono basic) | — | — | — | — | — |
| Sodium phosphate (Tri basic) | — | — | — | — | 1.000 |
| Zeodent 165 | — | — | — | — | — |
| Cocoamidopropyl Betaine (30% Soln) | — | — | — | — | — |
| Cetyl Alcohol | 3.000 | — | — | — | — |
| Stearyl Alcohol | 3.000 | — | — | — | — |
| Hydroxyethyl cellulose (HEC Natrasol 250M) | — | 0.500 | 0.500 | 0.500 | — |
| CMC 7M8SF | — | 1.300 | 1.300 | 1.300 | — |
| Xanthan Gum | — | — | — | — | 0.250 |
| Poloxamer 407 | — | — | — | — | — |
| Carrageenan mixture | — | 0.700 | 0.700 | 0.700 | 0.600 |
| Titanium dioxide | — | — | — | — | — |
| Saccharin Sodium | 0.500 | 0.500 | 0.500 | 0.500 | 0.500 |
| Flavor | 1.000 | 1.000 | 1.000 | 1.000 | 1.000 |
| Water | QS | QS | QS | QS | QS |
| | 33 | 34 | 35 | 36 | 37 |
| Sodium Gluconate | — | — | — | — | — |
| Stannous fluoride | — | — | — | — | — |
| Sodium fluoride | — | 0.243 | 0.243 | 0.243 | — |
| Sodium monofluorophosphate | 1.10 | | | | — |
| Zinc Lactate | — | — | — | — | — |
| Glycerin | — | — | — | — | 40.000 |
| Polyethylene glycol 300 | — | — | — | — | — |
| Propylene Glycol | | | | | |
| Sorbitol(LRS) USP | 24.000 | 42.500 | 42.500 | 42.500 | 30.000 |
| Sodium lauryl sulfate solution (28%) | 4.000 | 4.000 | — | 4.000 | — |
| Polyurethane foam particles as abrasive cleaning particles from the foam having foam density 33 kg/m$^3$/Vickers hardness 7 kg/mm$^2$/Blade mill grinded and sieved fraction 50-250 μm) | 5.000 | 10.000 | 10.000 | 5.000 | 15.000 |
| Zeodent 119 | — | — | — | 10.000 | — |
| Zeodent 109 | | | | | |
| Hydrogen peroxide (35% soln) | | | | | |
| Sodium hexametaphosphate | — | — | — | — | — |
| Gantrez | | | | | |
| Natural CaCO3-600M | 35.00 | — | — | — | — |
| Sodium phosphate (mono basic) | 0.10 | 0.420 | 0.420 | 0.420 | 0.420 |
| Sodium phosphate (Tri basic) | 0.40 | 1.100 | 1.100 | 1.100 | 1.100 |
| Zeodent 165 | 2.00 | — | — | — | 2.000 |

-continued

| Oral care composition (toothpaste) | | | | | |
|---|---|---|---|---|---|
| Cocoamidopropyl Betaine (30% Soln) | — | — | 5.000 | — | — |
| Cetyl Alcohol | 0.000 | — | — | — | — |
| Stearyl Alcohol | 0.000 | — | — | — | — |
| Hydroxyethyl cellulose (HEC Natrasol 250M) | — | 0.500 | 0.500 | 0.500 | — |
| CMC 7M8SF | 1.300 | 1.300 | 1.300 | 1.300 | 1.300 |
| Xanthan Gum | — | — | — | — | — |
| Poloxamer 407 | — | — | — | — | — |
| Carrageenan mixture | — | 0.700 | 0.700 | 0.700 | — |
| Titanium dioxide | — | — | — | — | — |
| Saccharin Sodium | 0.250 | 0.500 | 0.500 | 0.500 | 0.500 |
| Flavor | 1.000 | 1.000 | 1.000 | 1.000 | 1.000 |
| Water | QS | QS | QS | QS | QS |

| | 38 | 39 | 40 |
|---|---|---|---|
| Sodium Gluconate | — | — | 1.500 |
| Stannous fluoride | — | — | 0.454 |
| Sodium fluoride | — | — | — |
| Sodium monofluorophosphate | — | — | — |
| Zinc Lactate | — | — | — |
| Glycerin | 40.000 | 10.000 | 25.000 |
| Polyethylene glycol 300 | 3.000 | — | — |
| Propylene Glycol | — | — | — |
| Sorbitol(LRS) USP | — | 39.612 | — |
| Sodium lauryl sulfate solution (28%) | 5.000 | 4.000 | 4.000 |
| Polyurethane foam particles as abrasive cleaning particles from the foam having foam density 33 kg/m$^3$/ Vickers hardness 7 kg/mm$^2$/Blade mill grinded and sieved fraction 50-250 μm) | 15.000 | 5.000 | 5.000 |
| Zeodent 119 | — | — | — |
| Zeodent 109 | | | |
| Hydrogen peroxide (35% soln) | — | 8.570 | 8.570 |
| Sodium hexametaphosphate | 14.000 | — | — |
| Gantrez | — | — | — |
| Natural CaCO3-600M | — | — | — |
| Sodium phosphate (mono basic) | 0.420 | — | — |
| Sodium phosphate (Tri basic) | 1.100 | — | — |
| Zeodent 165 | 2.000 | — | — |
| Cocoamidopropyl Betaine (30% Soln) | — | — | — |
| Cetyl Alcohol | — | 3.000 | — |
| Stearyl Alcohol | — | 3.000 | — |
| Hydroxyethyl cellulose (HEC Natrasol 250M) | — | — | — |
| CMC 7M8SF | 1.000 | — | — |
| Xanthan Gum | 0.300 | — | — |
| Poloxamer 407 | 0.500 | — | 18.000 |
| Carrageenan mixture | — | — | — |
| Titanium dioxide | 0.500 | — | — |
| Saccharin Sodium | 0.500 | 0.500 | 0.500 |
| Flavor | 1.000 | 1.000 | 1.000 |
| Water | QS | QS | QS |

Zeodent 119, 109 and 165 are precipitated silica materials sold by the J. M. Huber Corporation.
Gantrez is a copolymer of maleic anhydride or acid and methyl vinyl ether.
CMC 7M8SF is a sodium carboxymethylcellulose.
Poloxamer is a difunctional block-polymer terminating in primary hydroxyl groups.

| Hair Shampoo | 41 | 42 | 43 |
|---|---|---|---|
| Water | q.s. | q.s. | q.s. |
| Polyquaterium 76 [1] | 0.25 | — | — |
| Guar, Hydroxylpropyl Trimonium Chloride [2] | — | 0.25 | — |
| Polyquaterium 6 [3] | — | — | 0.25 |
| Sodium Laureth Sulfate | 12 | 10.5 | 10.5 |
| Sodium Lauryl Sulfate | | 1.5 | 1.5 |
| Silicone [4] | 0.75 | 1.00 | 0.5 |
| Cocoamidopropyl Betaine | 3.33 | 3.33 | 3.33 |

-continued

| Hair Shampoo | 41 | 42 | 43 |
|---|---|---|---|
| Cocoamide MEA | 1.0 | 1.0 | 1.0 |
| Ethylene Glycol Distearate | 1.50 | 1.50 | 1.50 |
| Polyurethane foam particles as abrasive cleaning particles from the foam having foam density 33 kg/m$^3$/ Vickers hardness 7 kg/mm$^2$/Blade mill grinded and sieved fraction 50-250 μm) | 1 | | 2 |
| Crosslinked PS-DVB (50% DVB 55, | | 1 | |

-continued

| Hair Shampoo | | | |
|---|---|---|---|
| | 41 | 42 | 43 |
| mean diameter D(v, 0.9) 75 μm) abrasive cleaning particles | | | |
| Fragrance | 0.70 | 0.70 | 0.70 |
| Preservatives, pH & Visc. adjusters | Up to 1% | Up to 1% | Up to 1% |

[1] Copolymer of Acrylamide(AM) and TRIQUAT, MW = 1,000,000; CD = 1.6 meq./gram; Rhodia
[2] Jaguar C500, MW - 500,000, CD = 0.7, Rhodia
[3] Mirapol 100S, 31.5% active, Rhodia
[4] Dimethicone Fluid, Viscasil 330M; 30 micron particle size; Momentive Silicones The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning and/or cleansing composition comprising a) biodegradable polyurethane foam particles as an abrasive; and b) a suspending aid, wherein said polyurethane foam is formed from i) polymeric diisocyanate selected from the group consisting of polymeric toluene diisocyanate (TDI), polymeric methylene dianiline diisocyanate (MDI), and mixtures thereof, wherein the polymeric diisocyanate does not contain TDI and/or MDI monomers; and ii) polyols selected from the group consisting of polyethylene glycol, polycaprolactonediol, poly(ethylene adipate)diol, poly(hexamethylene adipate)diol and mixtures thereof, wherein the particles are non-spherical and have a Form Factor below about 0.6.

2. A liquid cleaning and/or cleansing composition according to claim 1, wherein said suspending aid is selected from the group consisting of polycarboxylate polymer thickeners, carboxymethylcellulose, ethyl cellulose, hydroxyethyl cellulose, hydroxypropyl cellulose, hydroxymethyl cellulose, succinoglycan and naturally occurring polysaccharide polymers, or mixtures thereof.

3. A liquid cleaning and/or cleansing composition according to claim 1, wherein said composition comprises said polyurethane foam particles in an amount of from about 0.1% to about 20% by weight of the composition.

4. A liquid cleaning and/or cleansing composition according to claim 3, wherein said composition has a pH from about 6 to about 8.

5. A liquid cleaning and/or cleansing composition according to claim 4, wherein said polyurethane foam has a density below about 100 $kg/m^3$.

6. A liquid cleaning and/or cleansing composition according to claim 5, wherein said polyurethane foam has open cell structure and polyurethane foam particles do not have a cell structure.

7. A liquid cleaning and/or cleansing composition according to claim 6, wherein said polyurethane foam has a no-detectable glass phase temperature or phase transition temperature of at least about 20° C., above usage temperature.

8. A liquid cleaning and/or cleansing composition according to claim 7, wherein said polyurethane foam particles have HV Vickers hardness from about 3 to about 50 $kg/mm^2$.

9. A liquid cleaning and/or cleansing composition according to claim 8, wherein said polyurethane foam particles have a mean particle size as expressed by the area-equivalent diameter from about 10 to about 1000 μm according to ISO 9276-6.

10. A liquid cleaning and/or cleansing composition according to claim 9, whereas the cleaning composition is loaded on a cleaning substrate whereas the substrate is a paper or non-woven towel or wipe or a sponge.

11. A process of cleaning and/or cleansing a surface with a liquid, cleaning and/or cleansing composition according to claim 9, wherein said surface is contacted with said composition.

12. A process according to claim 11, wherein said surface is an inanimate surface.

13. A process according to claim 11, wherein said surface is an animate surface.

14. A process of cleaning and/or cleansing a surface with a liquid, cleaning and/or cleansing composition according to claim 11, wherein said composition is applied onto said surface.

15. A process according to claim 12, wherein said inanimate surface is selected from the group consisting of: household hard surfaces; dish surfaces; leather; synthetic leather; and automotive vehicles surfaces.

16. A process according to claim 13, wherein said animate surface is selected from the group consisting of: human skin; animal skin; human hair; animal hair; and hard and soft tissue surface of the oral cavity, such as teeth, gums, tongue and buccal surfaces.

* * * * *